United States Patent [19]

Tucker et al.

[11] 4,330,897

[45] May 25, 1982

[54] FLOOR MACHINE

[75] Inventors: Jeffrey R. Tucker, Newark; Dennis W. Ross, San Leandro; Hartwell F. Tucker, Los Altos, all of Calif.

[73] Assignee: Octa, Inc., Mountain View, Calif.

[21] Appl. No.: 129,902

[22] Filed: Mar. 13, 1980

[51] Int. Cl.[3] ..... A47L 11/40

[52] U.S. Cl. ..... 15/246; 15/49 R; 51/177

[58] Field of Search ..... 15/50 R, 98, 49 R, 49 RB, 15/246; 51/177

[56] References Cited

U.S. PATENT DOCUMENTS

| | | | |
|---|---|---|---|
| 2,668,968 | 2/1954 | Dobrowolski | 51/177 X |
| 2,981,966 | 5/1961 | Beffel | 15/49 R X |
| 3,733,635 | 5/1973 | Carden | 15/49 R |
| 3,931,659 | 1/1976 | Pfefferkorn | 15/49 R |

FOREIGN PATENT DOCUMENTS

| | | | |
|---|---|---|---|
| 1417926 | 12/1975 | United Kingdom | 15/246 |

*Primary Examiner*—Edward L. Roberts

*Attorney, Agent, or Firm*—Jack M. Wiseman; Francis W. Anderson

[57] ABSTRACT

A machine for cleaning, polishing and otherwise finishing floors includes a friction-type mechanism for holding the handle of the machine in a preselected position, a dead-man switch control lever arranged for pivotal movement toward and away from the switch it controls, and an effective splash guard. Also disclosed is a helical gear transmission for driving the finishing pads, and a handle that has surfaces particularly adapting it for comfortable gripping by the operator's hands and for non-injurious contact by other parts of the operator's body.

8 Claims, 8 Drawing Figures

FLOOR MACHINE

BACKGROUND OF THE INVENTION

1. Field of the Invention

This invention relates to machines for cleaning, polishing and otherwise processing floors. More particularly, it concerns a floor machine having several advantageous structural features including an improved dead-man control switch, a simple effective handle-adjusting mechanism, an effective splash guard, a compact drive gear arrangement, and an effective cooling system.

2. Description of the Prior Art

It has been generally considered that for a floor machine of the type in which the full weight of the machine rests on the pad during operation to be effective for all desired operations, the machine had to weigh at least 100 pounds and the speed of its pad when in contact with the floor could not exceed approximately 350 rpm. These values were dictated in part by the fact that, for effective cleaning, a certain degree of downward pressure on the floor is necessary and to the fact that in certain operations, such as wet stripping, high speed of the pad was believed to cause hydroplaning of the pad with resulting ineffective floor contact. Accordingly, many present machines use rather heavy drive mechanisms designed to provide pad speeds below 350 rpm. On the other hand it has been recognized that pad speed greater than 350 rpm will result, in some instances in a superior finish on the floor. In one machine, speeds above 350 rpm are used but in this case part of the weight is supported on two rear wheels which remain in contact with the floor at all times and, as a result, the machine is moved in a more or less straight line forward and backward motion. Since a large portion of the weight of such machines is carried during operation by the wheels and, in one such machine, only about 13 to 15 pounds is effectively concentrated on the pad. In general, prior machines that have a weight of 100 pounds or more, rotate relatively slowly while in machines whose pads rotate at much higher speeds, the engagement of the wheels with the floor during operation restricts the weight of the machine from being applied fully to the pads.

Dead-man switch arrangements have been provided for floor machines which make use of various mechanisms, adapted to be associated with the cross-bar of the handle of the machine, including levers pivoted on fixed pins that are parallel to the cross-bar, levers pivoted on pins that are generally normal to the cross-bar, bars that are mounted for sliding movement toward and away from the cross-bar, and tubular members that are adapted to rotate on the cross-bar of the handle in the manner used in motorcycle hand controls. Apparatus has also been provided for permitting the handle to be moved to and to remain in any one of several pivoted angular positions between a vertical position and downwardly pivoted positions. Conventionally, to retain the handle in a selected angular position, some type of latch mechanism is used. When it is desired to move the handle to a different position, the operator must first release the latch. When the desired position is reached, the latch must be reengaged.

Several types of splash guards are currently being used on floor machines. In general, each of these consists of a splash ring that is adapted to lie loosely on the floor around the rotatable pad or brush in a position to be pushed by the machine as it moves over the floor.

In operation the control and manuevering of the machine is, of course, accomplished largely by the operator through his grip on the cross-bar of the handle. It is common practice to provide ridges, protuberances and grooves on the gripping areas in an attempt to assure maximum control. Other structural features of current floor machines, such as motor-driven gear drives, are in general of conventional design.

SUMMARY OF THE INVENTION

The present invention provides several structural and mechanical features that make possible an improved, more efficient machine. A dead-man switch actuator is provided that is of simplified construction, consisting only of a lever pivotally disposed in a groove in a control box housing. Similarly, the mechanism by which the handle is mounted on the machine for pivotal adjusting movement comprises a handle-receiving block held in frictional engagement with the walls of a bracket by a nut and bolt connection. A feature of the invention is the unique manner in which a splash guard is connected by springs so that the springs yieldably urge the guard to a centered position while also urging it into contact with the floor. The cross-bar at the upper end of the handle of this machine features smooth contours that may be comfortably gripped by the operator's hands and may be contacted by any other part of his body without injury. The machine is so designed that it has a weight of about 50 pounds and the drive mechanism is capable of rotating the pad at about 800–900 rpm while the total weight of the machine is carried by the pad.

It is therefore an object of the present invention to provide a floor machine having a simplified construction and one wherein the weight of the machine is about 50 pounds and the speed of rotation of the pad, while carrying the entire weight of the machine is in the neighborhood of 800–900 rpm.

DESCRIPTION OF THE PREFERRED EMBODIMENT

Figures 1, 2:
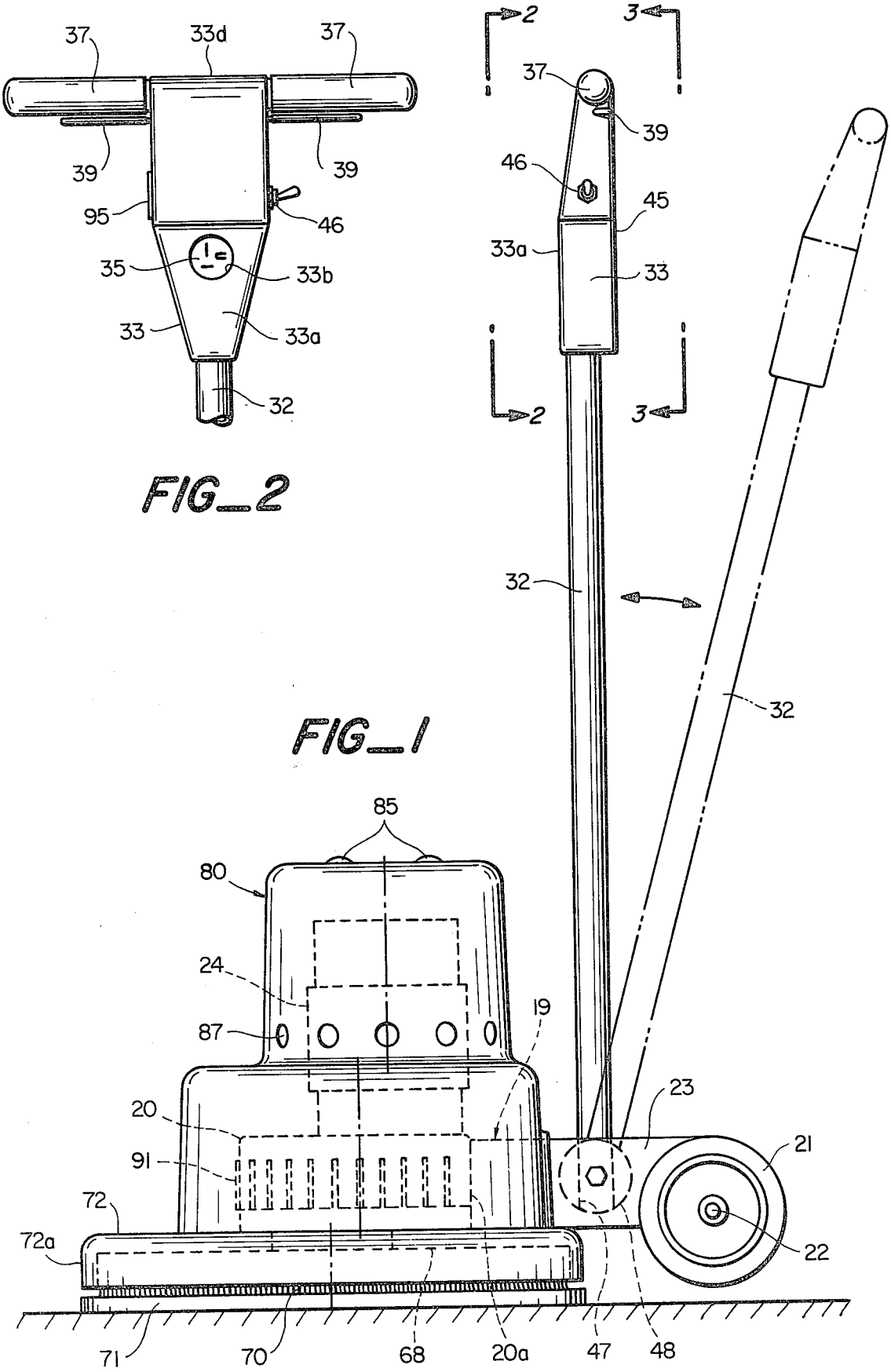
FIG. 1 is a schematic side elevation of the floor machine of the present invention.
FIG. 2 is a front elevation of a portion of the machine of FIG. 1, the view being taken looking in the direction of arrows 2—2 of FIG. 1.

The floor machine of the present invention, FIG. 1, comprises a base 19 which includes a two-piece elongated aluminum transmission housing 20 which is adapted to be supported during transport on two wheels 21 carried on an axle 22. The axle is journaled in opposed legs of a U-shaped steel bracket 23 which is part of the base and is secured to and extends rearwardly from a rear wall 20*a* of the housing 20. On its upper wall, the housing supports a motor 24 which has a cylindrical base projection centered in a recess in the upper wall to which it is secured by machine screws that extend upwardly through the wall.

Figure 7:
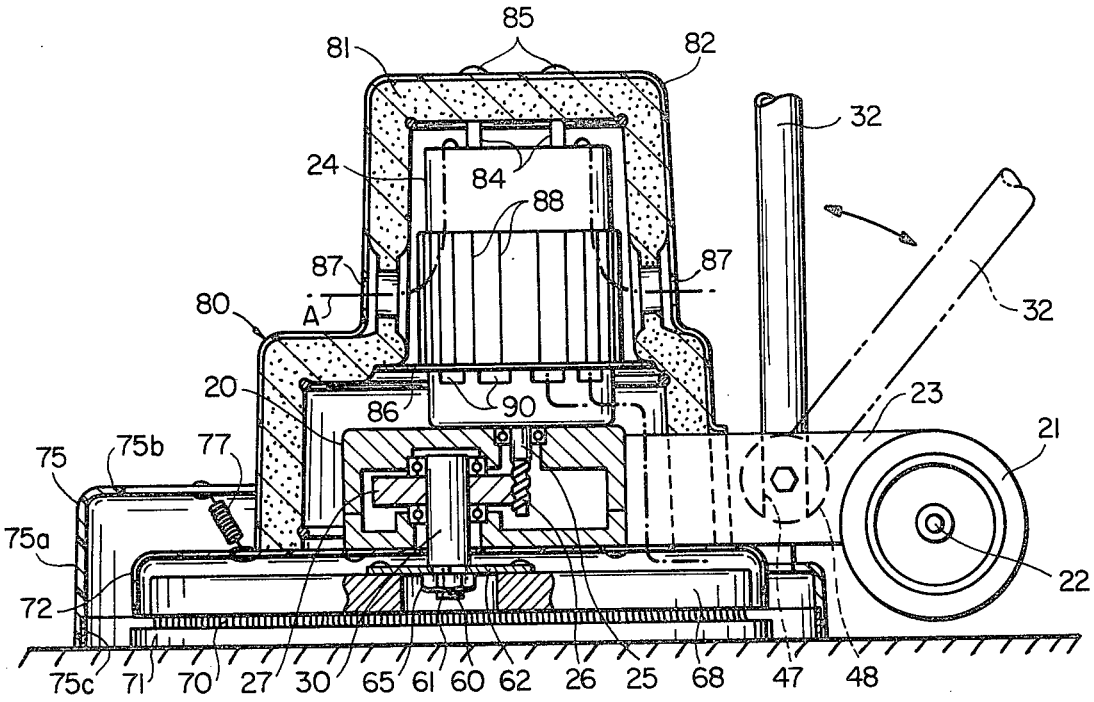
FIG. 7 is a fragmentary longitudinal vertical section, with parts in elevation, of the machine of FIG. 1 with a splash guard connected thereto.

As seen in FIG. 7, the motor has a shaft 25 which extends downwardly through an opening in the upper wall and has a pinion gear 26 integrally formed on its lower end portion. The pinion, which may be made as a separate unit and connected in driving relation to the motor shaft, has a plurality of helical teeth which mesh with the teeth of a helical output gear 27 disposed in the internal chamber provided by housing 20. The pinion and output gear combination is designed according to the teachings of U.S. Pat. Nos. 3,247,736 and 3,973,449, the pinion having four teeth and the output gear having fifty-two teeth. A gear reduction of 13 to 1 is obtained and, accordingly, if the motor speed is approximately 18,000 rpm, the output shaft 30 keyed to gear 27 is rotated at over 1300 rpm. In one arrangement, the pinion has four teeth and has a root diameter of 0.284 inches, a pitch diameter of 0.304 inches and an outside diameter of 0.511 inches while the output gear has fifty-two teeth, a root diameter of 3.686 inches, a pitch diameter of 3.9526 inches and an outside diameter of 4.095 inches. Accordingly, when the pinion and gear are in mesh, they occupy a space which has a maximum dimension transversely of the shafts of less than 4.75 inches. This compact gear arrangement makes possible a 13 to 1 gear reduction in a relatively small compact housing. If a different gear reduction is desired, the numbers of teeth on the pinion and gear may be varied. The pinion on the lower end of the motor shaft and the gear are products of the Quaker City Gear Works, Huntington Valley, Penna., the shaft with the pinion formed thereon being identified by Number SK-01-77 and the gear being identified as SK-02-77. The motor 24 is of the type known as a series universal, open ventilated motor. When connected to a 120 volt source and working against a torque of 125 oz. in., it should draw approximately 17 amperes and attain a speed of 12,000 rpm. It should be capable of developing about 1.5 hp and have a no-load speed of approximately 18,000 rpm.

A handle 32 in the form of a tubular speed pole projects upwardly from the bracket 23. At its upper end (FIG. 1) the pole extends into a cast aluminum control box 33 to which it is secured by bolts or by a suitable adhesive. The front face 33*a* (FIG. 2) of the control box, which is relatively flat, has a cylindrical aperture 33*b* formed therein. A generally cylindrical receptacle 34 (FIG. 5) is mounted on the back side of the front wall over the aperture 33*b*. The receptacle carries an electrical socket 35 that is adapted to receive the plug of an electric cord. The socket is electrically connected by wires extending through the tubular handle to the electric motor 24 so that, when a plug that is connected to a suitable source of electric energy is plugged into the socket and suitable switches are actuated, the motor is energized. It should be noted that, with this recessed receptacle arrangement the extension is completely separated from the control box and no cord segment extending from the control box is necessary. Therefore the possibility of cord breakage, in the area where a short cord segment would extend out of the box, due to continuous flexing of the cord segment is eliminated.

Figure 3:
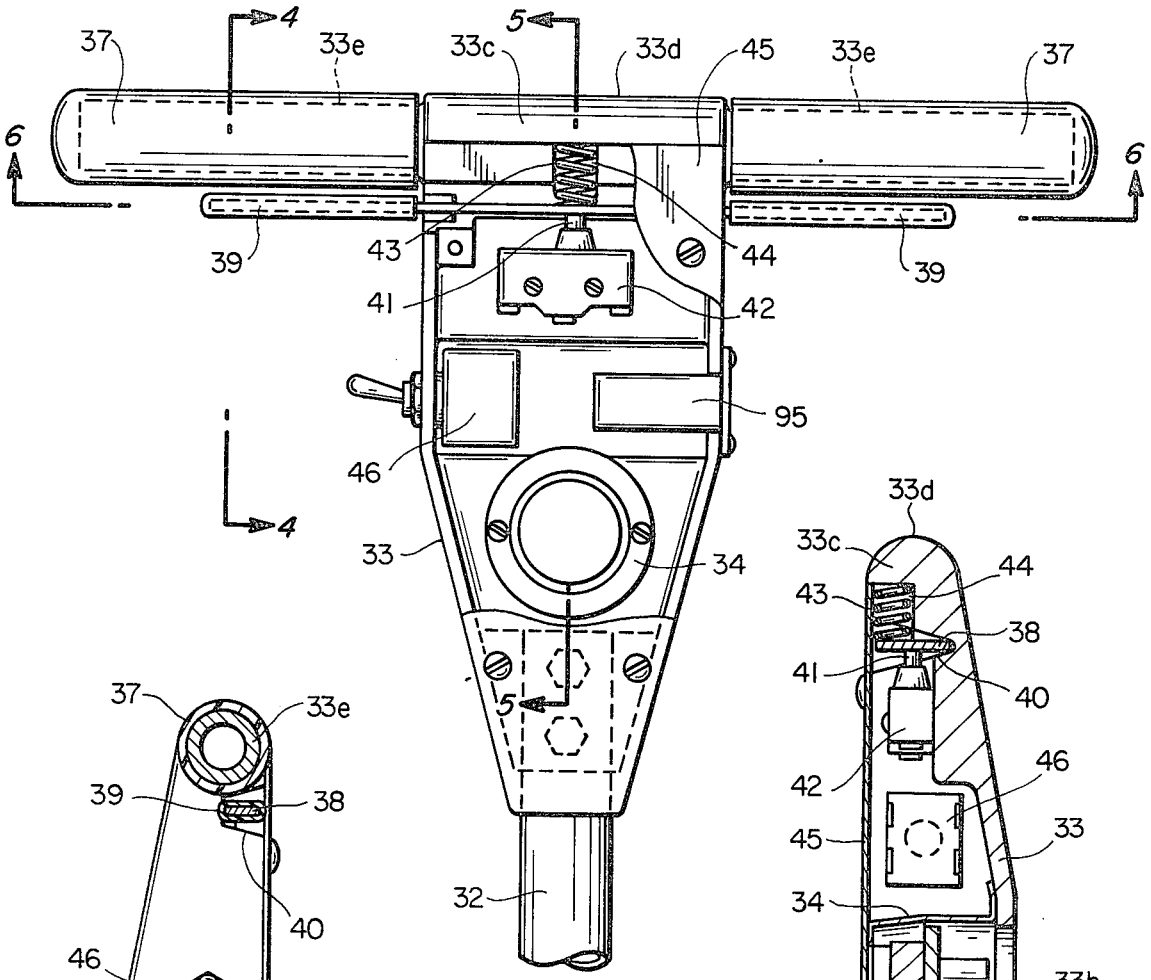
FIG. 3 is a schematic enlarged rear elevation, with parts broken away, taken looking in the direction of arrows 3—3 of FIG. 1.
Figure 5:
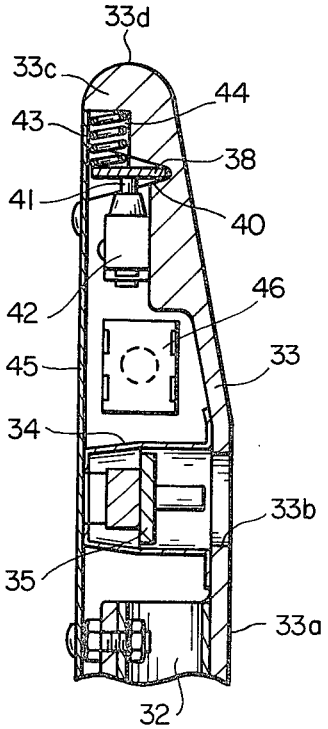
FIG. 5 is a section taken along lines 5—5 of FIG. 3.

Referring to FIGS. 3 and 5, it will be seen that an end wall 33*c*, integrally cast with the front and side walls of the control box, is provided with a semi-cylindrical outer surface 33*d*. Extending from each side of the end wall 33*c* is a cylindrical arm 33*e* on which a rubber or plastic grip 37 is disposed. The surface 33*d* of the end wall and the surfaces of the two grips 37 provide a smooth composite pushing surface against which an operator can exert pressure using any part of his body, such as his leg or stomach, without being jabbed by a protruding corner or edge. Also, the perfectly smooth surfaces of the grips have excellent non-slip gripping characteristics and are especially comfortable to the hands of the operator.

Figure 4:
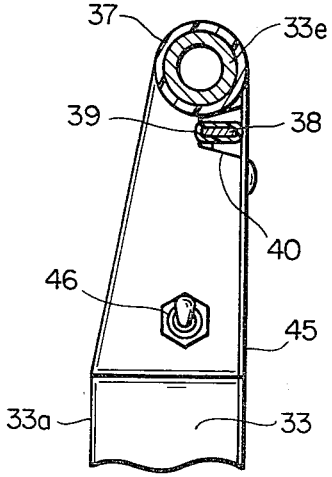
FIG. 4 is a section taken along lines 4—4 of FIG. 3.
Figure 6:
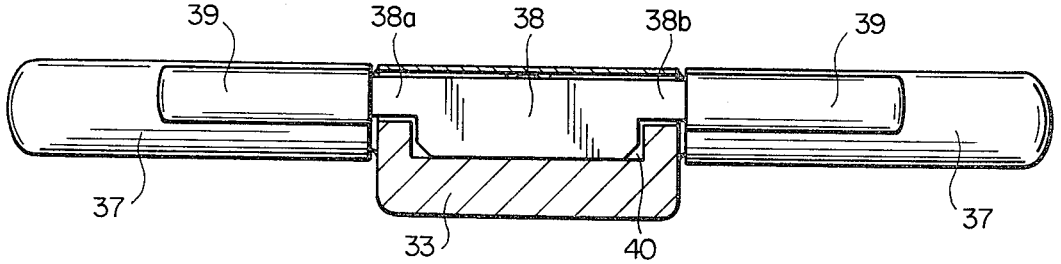
FIG. 6 is a section taken along lines 6—6 of FIG. 3.

The handle is provided with a dead-man's shut-off switch which comprises a trigger 38 in the form of a steel strap (FIGS. 3, 5 and 6) having plastic covers 39 at each end. The trigger is of generally rectangular cross-section and has two spaced portions 38*a* and 38*b* (FIG. 6), each of which has a lower end pivotally engaging the opposed edges near the bottom of a V-shaped notch 40 (FIG. 5) formed in each side wall of the control box 33. Near its central section, the trigger is urged against a push-rod 41 (FIG. 3) extending from an electrical switch 42 by a coil spring 43 which is disposed at its free end in a notch 44 formed in the end wall 33*c* of the control box and held therein by a cover plate 45. The switch 42 is connected in the control circuit of the motor 24 so that, when the operator grips the trigger 38 and pivots it toward the wall 33*d* against the resistance of coil spring 43, the push rod moves out of the switch housing to permit a portion of the control circuit to close. If all other switches in the circuit, such as switch 46 have been suitably actuated, the motor will be energized. When the operator releases his grip on the trigger 38, the spring pivots the trigger away from the grips 37 of the handle and exerts a pressure on the trigger which is transmitted to the push rod to open the switch contacts and de-energize the circuit. It should be noted in FIG. 4 that, when the trigger is pivoted toward the wall 33*d*, it will lie fairly close to the adjacent grip 37 so that the operator's hand can comfortably enclose both the grip and the trigger at the same time.

Figure 8:
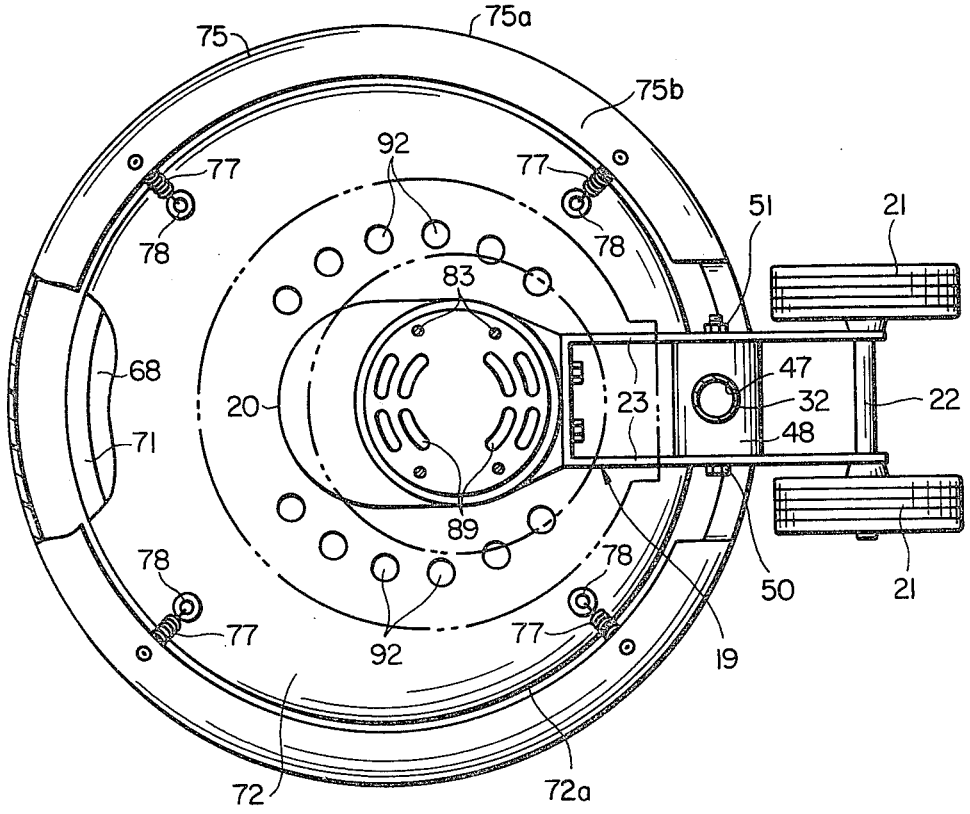
FIG. 8 is a top plan view of the machine of FIG. 7 with the insulated cover of the machine removed and indicated only by phantom lines.

A special feature of the floor machine of the present invention is illustrated in FIG. 8 wherein it will be seen that the lower end of the handle pole 32 is secured by means of a press-fit or a suitable adhesive in a cylindrical hole 47 in a cylindrical position-control block 48 that is made of aluminum and fits snugly between the walls of the U-shaped bracket 23. A bolt extends through an axial opening in the block 48 and transversely through the pole 32 in the block, the head 50 of the bolt being disposed on one side of the bracket and a nut 51, which is threaded on the bolt, being on the other side of the bracket. In the present embodiment, the pole is press-fit or adhesively secured in the block. In a modified form, the walls of the pole are made rather thick and the pole is secured in the block by the action of the nut 51 and bolt.

It is evident that the block 48 has frictional contact with the inner surfaces of the side walls of the bracket at two circular areas and, in accordance with the present invention, it is this frictional contact that allows the pole handle 32 (FIG. 7) to assume and maintain an upright position or any of a plurality of inclined positions. Further, this frictional contact is such that, although the pole will retain the angular position in which it is placed, the operator can change the angular position relative to the rest of the machine, which will be called a power unit, without changing the setting of the nut merely by bracing the unit by foot or hand and moving the handle to the desired position. In one successful arrangement, the cylindrical block 48 is formed of aluminum that is nickel or chrome-plated. The bracket, which was made of steel, was also nickel or chrome-plated. The block was 2.5 inches in diameter and had a central axial cylindrical hole that was 0.375 inches in diameter extending therethrough. Each end surface, accordingly, had a contact surface of approximately 4.80 square inches. When the nut 51 was tightened sufficiently on the bolt 50, thus pressing the friction surfaces into close engagement, the handle pole remained in any angular position relative to the power unit to which it was moved—from a vertical to a horizontal position. Moreover, the frictional engagement was such that the handle could be adjusted to any desired angular position without loosening the nut. The time at which no pivoting of the handle relative to the power unit is desired is during transport of the unit, since at that time the unit has been pivoted back and only the wheels are on the floor. As the wheels move over a floor or the like, even small bumps may cause the unit to pivot away from the handle and hit the floor with considerable impact. The above-described frictional lock is effective to maintain the selected angular relation between the pole and the unit even at this critical time.

While one arrangement has been described, the same advantageous effect can be obtained by use of other material combinations and other sized blocks. In one arrangement the end surfaces of the block 48 were roughened, as by saw cuts, to increase the frictional grip of the contact members. The materials and size of the frictional contact area must be chosen after taking into consideration the effective length and weight of the handle pole, and the weight of the power unit since, as mentioned above, its weight is a factor during transport. The side walls of the bracket 23 must be made rigid enough to maintain flat contact with each end of the cylindrical block 48.

Since electric wiring extends down through the hollow handle pole, the hole 47 in which the lower end of the pole is pressed is extended completely across the block to provide an exit opening for the wires.

Referring to FIG. 7, it will be seen that the output shaft 30 is supported in bearing units in the transmission housing. At its lower end the output shaft has a threaded section 60 disposed immediately below a square drive section 61. A steel drive plate 62, which has a square central opening in which the square section 61 of the output shaft is disposed in driving relation, is locked on the output shaft by a nut 65 threaded on the lower end of the shaft. A cylindrical wooden base 68 of a pad drive unit is secured, as by bolts, to the underside of the drive plate. The pad drive unit comprises the plate 62, the base 68, and a plurality of closely spaced drive pins or tufts 70 made of rigid plastic and embedded in the lower surface of the base to project downwardly therefrom, either straight down from the base or at a small angle relative to the straight down position.

The drive unit is 17 inches in diameter and each of several different floor processing pads 71, that are 18 inches in diameter, is adapted to be placed under the drive unit with the drive pins of the unit embedded in driving engagement in the pad. If the pad is placed under the drive unit in concentric relation therewith, an 18 inch circular area of the floor will be processed. If the pad is placed off-center relative to the drive unit, a larger circle will be processed. A fiberglass drive guard 72, which is secured to the underside of the transmission housing 20, has a generally cylindrical skirt **72*a* surrounding the rotating drive unit. The guard not only carries out a safety function, but also protects walls and the like. Since the outside diameter of the skirt 72*a*** is slightly less than the diameter of the 18 inch pad, the outer edge of the pad will project outwardly a short distance from under the skirt. Accordingly, it is possible to clean and polish very close to a wall or the like when the guard engages the wall.

In FIGS. 7 and 8 the floor machine is illustrated as equipped with a splash guard 75 which adapts the machine for wet stripping. Wet stripping can be accomplished using a pad, however, it is most effectively accomplished by replacing the pad with a brush unit as will be explained presently. The brush has the general configuration of the unit which includes the base 68, the pins 70 and the pad 71 but is somewhat deeper. The splash guard, which is made of fiberglass, is a generally cyclindrical member having a side wall **75*a* and an inturned lip 75*b* at its upper end, and a cut-out rear portion to receive bracket 23. At appropriate intervals, such as 90 degree intervals, around the underside of the lip, coil springs 77 (FIG. 8) are secured as by rivets. Each spring has a hook formed on its lower end and each hook is adapted to be disposed in hooked engagement in one of a plurality of holes 78 provided at 90 degree intervals around the top surface of the drive guard 72**. It will be evident that the springs are disposed substantially in radial planes extending outwardly from the axis of rotation of the rotary power unit and urge the splash guard downwardly into contact with the floor being processed and inwardly toward the center of the drive unit. Therefore, in normal operation, the brush or pad will not touch the splash guard. If the splash guard engages an obstruction, such as a table leg, the springs will allow the guard to shift laterally. When the obstruction is disengaged, the springs move the guard back to a centered position. When it is desired to work close to a wall, the springs allow the splash guard to yield and permit the brush to reach the desired surface.

A steel band **75*c*** is secured in a recess on the inner surface of the splash guard at the lower annular end thereof to protect the guard from the action of the brush that is used in the wet stripping operation.

A cover 80 (FIG. 7) is disposed over the motor and transmission housing. The cover includes a fiberglass lining 81 and a fiberglass cover 82 surrounding the lining. The fiberglass insulating lining may be in the form of mats held in place by spring clips or it can be provided in preformed circular, cylindrical and annular shapes that are rigid enough to maintain their position closely adjacent the inner surface of the cover 82. The lower circular surface of the cover abuts the upper surface of the drive guard 72, and the cover is held in place by four studs 83 (FIG. 8) that are anchored in the upper end of the motor 24 and project upwardly therefrom. Internally threaded standoff nuts 84, which are threaded on the studs, extend through the cover, and large-headed screws 85 threaded into the nuts hold the cover in fixed position relative to the motor.

The rotation of the pad or brush sets up an air flow within the cover which is indicated generally in FIG. 7 by dot-dash line A. The air is drawn into the cover through a plurality of ports 87. Since a relatively thin steel baffle wall 86 extends across the inside of the cover near the lower portion of the motor, the air is directed upwardly over cooling fins 88 on the cylindrical outer surface of the motor toward the top of motor 24. The air then turns downwardly and passes into vent ports 89 (FIG. 8) in the top plate of the motor. It passes downwardly through the motor, exits through ports 90 (FIG. 7) and passes downwardly over the cooling fins 91 (FIG. 1) on the outer surface of the transmission housing 20. The air then passes through apertures 92 (FIG. 8) in the drive guard 72 and is discharged below the rim of the drive guard. Referring to FIG. 7, it will be noted that the pad or brush causes air to flow radially outwardly and downwardly as it exits at the lower periphery of the unit. This rapidly moving air sets up a venturi effect that draws the air from around the transmission housing through the holes 92.

Referring to FIG. 3 it will be noted that an elapsed time indicator 95 is mounted inside the control box 33 adjacent an aperture in the side wall of the box. This unit measures the time that the floor machine is in operation and it is provided with a dial which indicates this elapsed time faces outwardly through the aperture in the wall.

As mentioned above, several different types of pads can be used with this machine. The construction of each type of pad and the type of material used to make up the pad varies with the type of use to which it is to be subjected. Various natural fibers, animal hair, steel wire, steel wood, plastic fibers and the like may be found in these pads. The present machine is particularly adapted to use an orange color-coded pad for efficient cleaning of relatively dirty floors, a tan pad that is effective to perform a light cleaning and a buffing or polishing operation, and a white pad used solely for polishing.

When the machine is to be used for wet stripping, the pad drive unit is removed from the machine by backing off the nut 65 (FIG. 7). A circular brush, having a drive plate similar to the drive plate 61, is mounted on the bolt 60. The brush is deep enough to hold the lower edge of the drive guard 72 off the floor and has a diameter adapting it to rotate inside the guard 72. During operation, the brush spreads out somewhat and the outer edges of the bristles will extend outwardly under the lower edge of the drive guard 72.

In this embodiment the transmission housing 20 is cast in two sections, an upper section and a lower section. In plan, both sections have the elongate configuration shown for the housing 20 in FIG. 8, being longer than they are wide. The upper section has a top wall that is about 0.875 inches thick at its rear portion where the motor shaft 25 is located and about 0.700 inches thick at its forward portion above the output shaft 30. The upper section is about 2.31 inches deep and has an encircling side wall that is 0.250 inches thick except at the rear wall portion 20*a* where it is about 1.00 inches thick. The lower section of the housing is about 1.00 inches deep and has side walls matching the side walls of the upper section in thickness and configuration. The lower section has a bottom wall about 0.375 inches thick.

While a preferred embodiment has been described and certain materials and dimensions have been specified, it is within the scope of the present invention to use different materials for various parts to carry out the functions described herein for those parts and to vary the dimensions as dictated by the material used.

From the foregoing description it will be evident that the floor machine of the present invention features several mechanisms which make the machine a relatively simple but effective unit.

The dead-man switch is a plain steel bar and its pivotal mounting in the control box 33 consists only of two spaced notches in the side walls of the box. The mechanism for permitting the handle 32 to be moved selectively to several angular positions and to retain each selected position until positively moved to another position involves only the proper selection of contacting friction surfaces. The springs 77 are effective to keep the splash guard in contact with the floor and centered relative to the rotating pad or brush.

Since fiberglass, plastic and aluminum are used wherever feasible, the presently preferred embodiment of the unit weighs only 50 pounds. The lightweight construction permits the 1.5 hp motor, during a finishing operation, to maintain a speed around 13,000 rpm and to rotate the pad in the range of 800–900 rpm with the full weight of the pad, plus a 15 pound electric cord, on it. This combination of speed and weight makes possible an easily manueverable, highly effective cleaning and polishing machine.

We claim:

1. In a floor machine having a power driven rotary unit, the improvement which comprises an annular splash guard surrounding said unit, and means connected between said unit and said annular splash guard in a manner to impart radially-inward forces on said splash guard for urging said guard to a centered position relative to the axis of said rotary unit.

2. In a floor machine having a power driven rotary unit, the improvement which comprises an annular splash guard surrounding said unit, and a plurality of springs connected between said guard and said rotary unit and disposed substantially in imaginary radial planes projecting outwardly from the axis of rotation of said unit for urging said guard to a centered position relative to the axis of said rotary unit.

3. In a floor machine having a cover enclosing a power driven drive unit, the improvement which comprises an annular drive guard encircling a portion of said drive unit, an annular splash guard surrounding said drive guard and having an upper portion above and radially outward of said drive guard, and means connected between said upper portion and said splash guard for urging said splash guard downwardly and inwardly toward the axis of said annular drive guard.

4. In a floor machine comprising:

a base housing, a drive mechanism having a drive shaft extending vertically through said housing, a motor connected to said drive shaft and mounted above said housing, a brush disposed below said housing and secured to said drive shaft for rotation therewith, a drive guard secured to the underside of said housing and having a cylindrical skirt disposed concentrically of said drive shaft, a bracket secured to and extending in a generally radial direction away from said housing, and a control handle pivotally mounted on said bracket, the improvement which comprises a splash guard having an upper generally horizontal top wall and a cylindrical side wall, said splash guard having a recess in said side wall receiving a portion of said bracket that is between said housing and said control handle, means defining a central opening in said upper wall and a ledge projecting inwardly from the upper edge of said side wall, said opening being adapted to receive said base housing and said motor projecting upwardly therethrough, means defining an annular recess on the inner side of said cylindrical side wall of the splash guard at the lower end thereof, a steel band secured in said recess between a portion of said side wall and the periphery of the brush, rivets secured in the ledge of said upper wall of said splash guard near the inner edge thereof at approximately 90° intervals therearound, means providing holes in the upper surface of said drive guard at about 90° intervals therearound, and four coil springs, each spring extending downwardly and inwardly and being anchored to said splash guard by one of said rivets and having a hooked end engaged in one of the holes in the drive guard, said springs being effective to urge said splash guard downwardly and inwardly toward an extension of the axis of rotation of said drive shaft.

5. In a floor machine having a power driven rotary unit, the improvement which comprises an annular splash guard surrounding said unit, and means connected between said unit and said annular splash guard for urging said guard to a centered position relative to the axis of said rotary unit, said annular splash guard having a cylindrical side wall, and wherein said side wall has a recess adapted to receive a mounting bracket for a control handle of the machine.

6. The floor machine of claim 5 wherein said bracket has frictional surfaces in gripping engagement with said control handle and wherein means is provided for varying the position of said handle relative to said bracket.

7. In a floor machine having a power driven rotary unit, the improvement which comprises an annular splash guard surrounding said unit, and means connected between said unit and said annular splash guard for urging said guard to a centered position relative to the axis of said rotary unit, said splash guard having a cylindrical skirt and means defining an annular recess in the inner surface of said skirt at the lower end thereof, and further including an annular steel band secured in said recess between said rotary unit and a portion of said skirt.

8. In a floor machine having a power driven rotary unit, the improvement which comprises an annular splash guard surrounding said unit, and means connected between said unit and said annular splash guard for urging said guard to a centered position relative to the axis of said rotary unit, said centering means including a drive guard surrounding said power unit, means defining openings in a top wall of said drive guard in a generally circular pattern at 90° intervals, means defining an annular inturned ledge on said splash guard at an elevation above the top wall on said splash guard at an elevation above the top wall of said drive guard, four coil springs, each spring having a hook at one end adapted to be engaged in one of the openings in the top wall of said drive guard, and means for anchoring the other end of each spring in the annular ledge of said splash guard near an inner edge thereof, each spring being secured in said ledge at a point spaced about 90° angularly around said annular ledge from an adjacent spring, and each spring being oriented in a downwardly and inwardly extending direction for urging said splash guard downwardly as it urges it to centered position.

* * * * *